US005150018A

United States Patent [19]

Bruning et al.

[11] Patent Number: 5,150,018

[45] Date of Patent: Sep. 22, 1992

[54] GAS DISCHARGE LAMP WITH GRID AND CONTROL CIRCUITS THEREFOR

[75] Inventors: Gert W. Bruning, Tuckahoe, N.Y.; Leo F. Casey, Watertown, Mass.; Paul R. Veldman, Oss; Klaus Vegter, Nuenen, both of Netherlands

[73] Assignee: North American Philips Corporation, New York, N.Y.

[21] Appl. No.: 744,190

[22] Filed: Aug. 12, 1991

[51] Int. Cl.[5] ..... H01J 11/04; H01J 15/04

[52] U.S. Cl. ..... 315/349; 315/208; 315/DIG. 1

[58] Field of Search ..... 315/207, 208, DIG. 1, 315/340, 349; 313/492, 597, 293, 616, 308, 294

[56] References Cited

U.S. PATENT DOCUMENTS

| | | | |
|---|---|---|---|
| 2,117,246 | 5/1938 | Haglund | 313/597 |
| 2,586,403 | 2/1952 | Waguet | 315/349 |
| 2,586,404 | 2/1952 | Waguet | 315/DIG. 1 |
| 3,611,024 | 10/1971 | Nakatsu | 315/205 |
| 4,194,143 | 3/1980 | Farkas et al. | 315/208 X |
| 4,302,707 | 11/1981 | Hattori | 315/208 X |
| 4,521,718 | 6/1985 | Byszewski et al. | 315/349 X |
| 4,620,135 | 10/1986 | Donaldson et al. | 313/597 X |

*Primary Examiner*—Eugene R. LaRoche
*Assistant Examiner*—Son Dinh
*Attorney, Agent, or Firm*—Edward Blocker; Robert T. Mayer

[57] ABSTRACT

The combination of a fluorescent lamp with a grid between its electrodes and control equipment for operating the lamp in an on condition and an off condition by the application of pulses to the grid.

21 Claims, 3 Drawing Sheets

GAS DISCHARGE LAMP WITH GRID AND CONTROL CIRCUITS THEREFOR

This is an invention in the lighting art. More particularly it involves a fluorescent lamp with a grid between its two conducting electrodes for controlling the operation of the lamp.

This application is related to copending application Ser. No. 634,370 entitled Grid Controlled Gas Discharge Lamp filed Dec. 27, 1990 and assigned to the same assignee as this application. Application Ser. No. 634,370 is incorporated by reference herein.

Traditionally fluorescent lamps have been operated with inductive ballasts and an alternating current voltage of approximately 120 volts and a frequency of 60 cycles per second. The availability of fast solid state switches capable of interrupting the operating current of fluorescent lamps has made practical the operation of such lamps at frequencies between 20 KHz 100 KHz. Operation at these high frequencies is more efficient in that there are more lumens produced per watt than at low frequency operation.

One of the objects of the invention is to provide high frequency operation of fluorescent lamps without the need for a power switch to interrupt the operating current of such a lamp.

It is a feature of the invention to provide a fluorescent lamp with a grid between its electrodes. By controlling the voltage on the grid the lamp can be switched between a conducting state and a non-conducting state and vice versa.

In the past when fluorescent lamps were operated in parallel invariably the different characteristics of each of the lamps can cause one of the lamps to conduct most of or the entire circuit. One of the advantages of this invention is that fluorescent lamps may be operated in parallel and each one will operate efficiently without its operation being detracted from by the operation of another lamp in parallel therewith.

In carrying out the invention there is provided in combination a source of voltage and a fluorescent lamp connected to the source of voltage for operation in response thereto from a non-conducting state to a conducting state. The fluorescent lamp has a control grid which operates to control the lamp in both its conducting state and its non-conducting state in response to control signals received by the control grid. The combination also includes control means for generating the control signals for the grid.

Other objects, features and advantages of the invention will be apparent from the following description and appended claims when considered in conjunction with the accompanying drawing in which;

Figure 1:
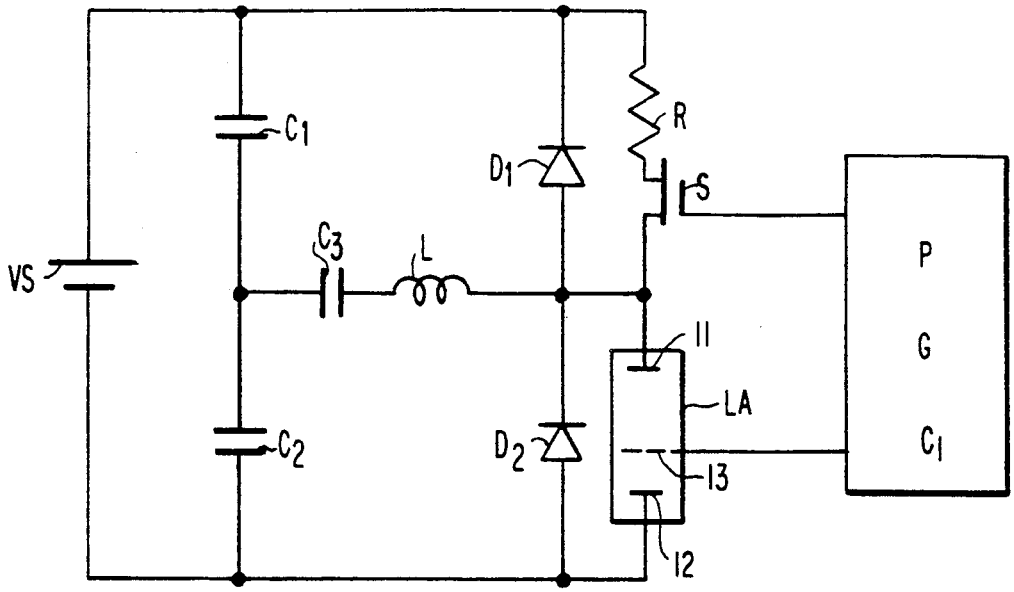
FIG. 1 is a schematic diagram of a constructed embodiment of the invention.

Referring to FIG. 1, there is shown the constructed embodiment of lamp LA and a simplified version of the control means for operating lamp LA between its conducting and non-conducting states. Lamp LA in the constructed embodiment was a standard T12 40 watt fluorescent lamp with grid 13 of a 80 mesh per square inch mounted between its electrodes 11 and 12 in accordance with the forementioned copending Pat. application Ser. No. 634,370. Connected in series with lamp LA across voltage source VS are resistor R and switch S. Also connected across voltage source VS are capacitors $C_1$ and $C_2$ and diodes $D_1$ and $D_2$. Capacitor $C_3$ and inductance L are connected in series between the junctions between capacitors $C_1$ and $C_2$, diodes $D_1$ and $D_2$ and switch S and lamp LA. The gate of switch S and grid 13 of lamp LA are connected to pulse generating circuitry $PGC_1$. Pulses from pulse generating circuitry $PGC_1$ enable switch S and lamp LA to operate in the on and off conditions.

In the constructed embodiment the calculated damped resonant frequency was approximately 28 KHz. When switch S and lamp LA were each turned on and off at a frequency of 30KHz (termed the inductive mode), the operating voltage applied to grid 13 to turn lamp LA off was −165 volts with respect to electrode 12 with a duty cycle of about 50%. Switch S was operated in like fashion as those skilled in the art will understand. The voltage on grid 13 when lamp LA is on is floating. Under these circumstances the voltage applied by voltage source VS was about 300 volts. The values of the other components in the circuitry shown in FIG. 1 were as follows:

$C_1$—470 nf
$C_2$—470 nf
$C_3$—8.2 nf
L —2 mh
$D_1$—BYV 95C—Philips
$D_1$—BYV 95C—Philips
R—250 ohms
S—IRF 830 International Rectifer In the constructed embodiment where switch S and lamp LA were each being turned on and off at a frequency of 25KHz (termed the capacitive mode), the operating voltage applied to grid 13 to turn lamp LA off with an operating frequency of 25 KHz was −165 volts with respect to electrode 12 also applied for a duty cycle of about 50% . Under these circumstances the voltage applied by voltage source VS was about 300 volts. Operation in the inductive mode is similar except for the forementioned higher frequency. The values of the other components in the circuitry shown in FIG. 1 were the same as for the inductive mode.

Figure 6:
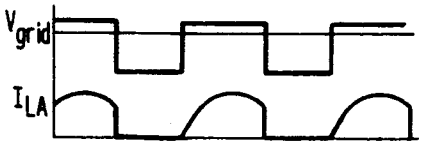
FIGS. 6 and 7 show grid voltage and lamp current curves.
Figure 7:
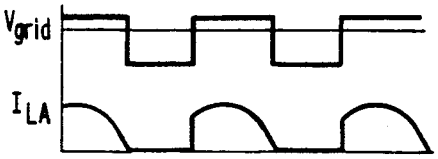

The inductive mode and the capacitive differ in operation in the following aspects. In the inductive mode (see FIG. 6 for grid voltage and lamp current curves) the grid interrupts the lamp current at turn-off. At turn-on the lamp current ramps up from zero with a limited dI/dt. In the capacitive mode (see FIG. 7 for grid voltage and lamp current curves) the circuit drives the current to zero and the grid is made negative. This grid voltage keeps the lamp off. At turn-on, there is a step in the lamp current with a high dI/dt.

As those skilled in the art will understand, diode D1 provides a circulating current path for the dissipation of energy stored in inductance L after lamp LA turns off and before switch S is turned on during each cycle. This path comprises inductance L, diode D1 and capacitances C1 and C3.

Similarly, diode $D_2$ provides a circulating current path for the dissipation of energy stored in inductance L after switch S turns off and before lamp LA is turned on during each cycle. This path comprises inductance L, capacitances C3 and C2 and diode D2.

Figure 2:
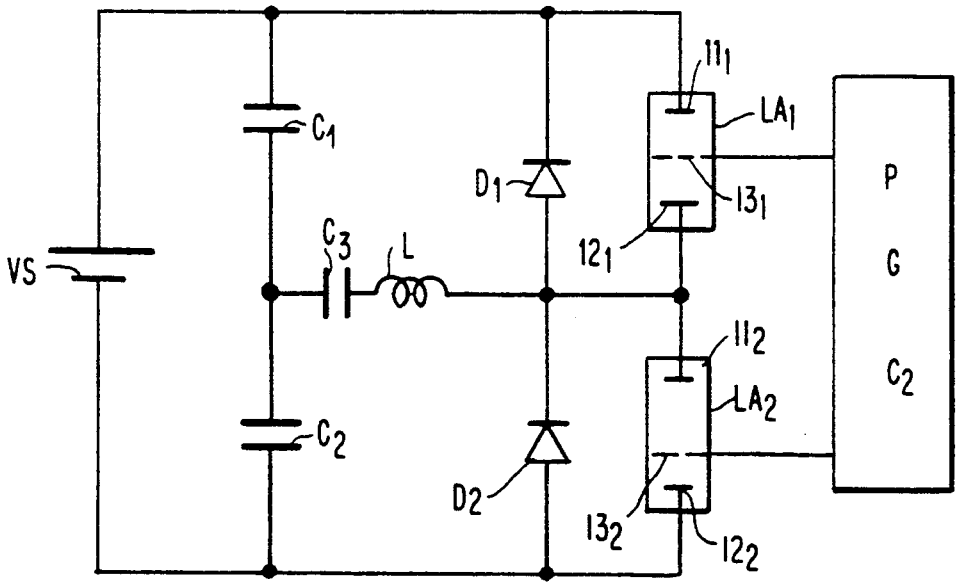
FIG. 2 is an alternate embodiment of the invention with two lamps.

FIG. 2 shows two lamps $LA_1$ and $LA_2$ connected in series across voltage source VS. As is evident lamp $LA_1$ has been substituted for resistor R and switch S of the constructed embodiment. To distinguish lamps $LA_1$ and $LA_2$ their electrodes are identified as $11_1$ and $12_1$ and $11_2$ and $12_2$, respectively. The grids $13_1$ and $13_2$ of lamps $LA_1$ and $LA_2$, respectively are connected to a pulse generating circuit $PGC_2$. It is contemplated that lamps $LA_1$ and $LA_2$ will operate sequentially in the same manner as switch S and lamp LA of the constructed embodiment shown in FIG. 1 operated. With this arrangement, the illumination of the lamps can be changed by changing the applied frequency. In the inductive mode, if the frequency is raised the illumination will be decreased and vice-versa. In the capacitive move, it is just the opposite.

Figure 3:
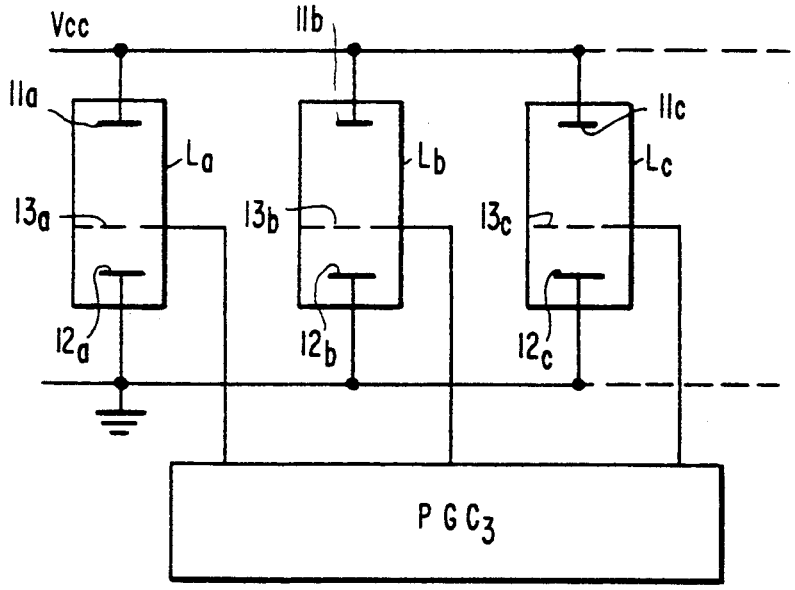
FIG. 3 is an embodiment of the invention with a plurality of lamps connected in parallel.

FIG. 3 shows a plurality of lamps La, Lb and Lc connected in parallel between line Vcc and ground. The electrodes of these lamps are identified consistently as $11_a$ and 12*a*, 11*b* and 12*b* and 11*c* and 12*c*. The grids of these lamps are identified by the reference characters 13*a*, 13*b* and 13*c*. Each grid is connected to a pulse generating circuit $PGC_3$ It is to be understood that contrary to conventional circuits with parallel fluorescent lamps where one lamp can degrade the performance of other lamps this would not occur in the circuit configuration of FIG. 3 if each of the lamps La, Lb and Lc is operated one at a time in sequence as opposed to being operated concurrently. This is also true when the lamps are operated concurrently but each with its own appropriate duty cycle. This is so because of the advantage obtained by the fact that grids 13*a*, 13*b* and 13*c* enable their respective lamps La, Lb and Lc to be in the conductive and non-conductive states independently by energizing the respective grids with pulses from pulse generating circuit $PGC_3$.

Figure 4:
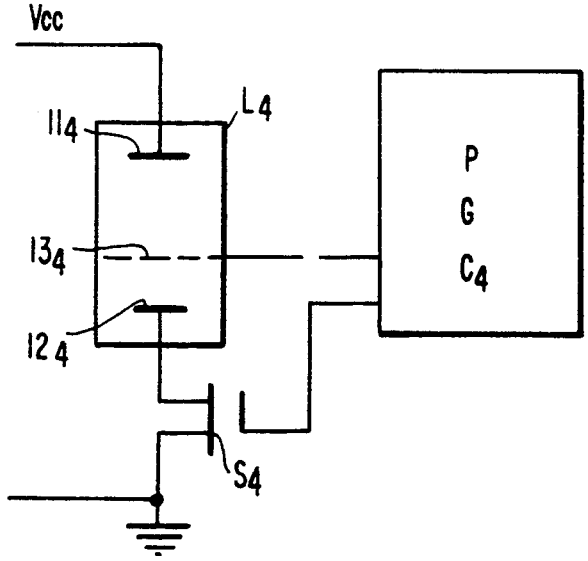
FIG. 4 is an embodiment of the invention with supplemental control equipment connected to one electrode of a fluorescent lamp with a grid.

FIG. 4 shows a grid lamp $L_4$ with its one electrode $11_4$ connected to line Vcc and its other electrode $12_4$ connected through switch $S_4$ to ground. Both the grid $13_4$ of lamp $L_4$ and the gate of switch $S_4$ are connected to pulse generating circuit $PGC_4$. With this arrangement the state of lamp $L_4$ can be controlled by controlling the operation of switch $S_4$ through pulses provided appropriately to its gate from pulse generating circuit $PGC_4$. Although grid $13_4$ is connected to pulse generating circuit $PGC_4$ and can be supplied with pulses from that circuit for on-off operation of lamp $L_4$ it is to be understood that a constant voltage could be applied to grid $13_4$ with switch $S_4$ acting to provide lamp on-off operation.

Figure 5:
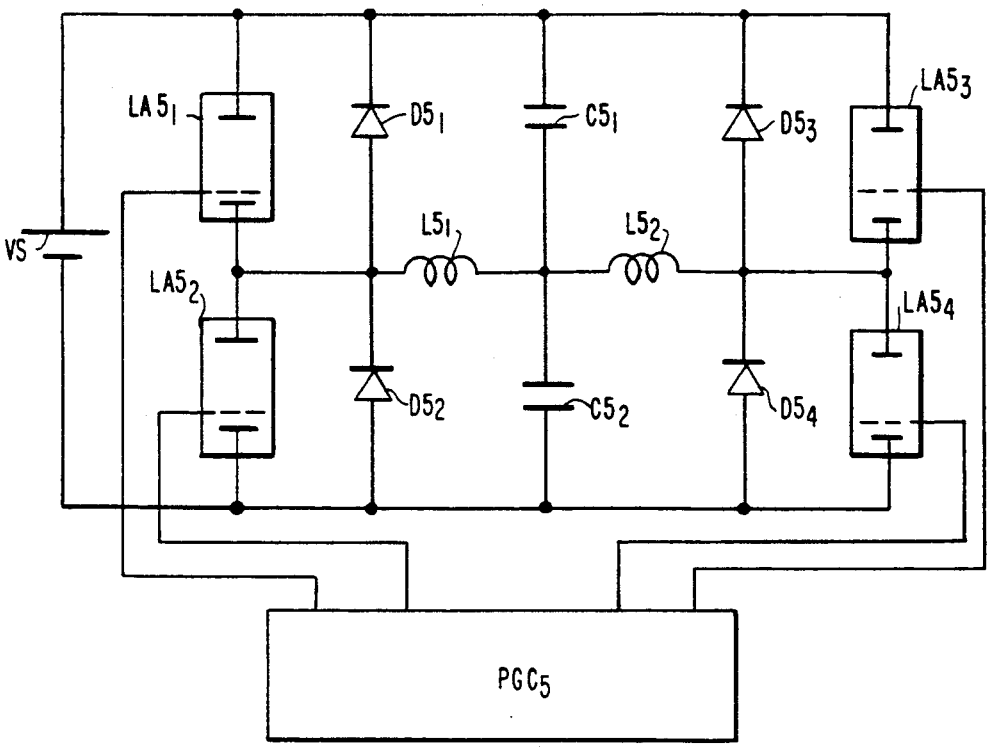
FIG. 5 is an embodiment of the invention with dimming control.

FIG. 5 shows circuitry which is similar to that of FIG. 2 but includes four grid lamps $LA5_1$ through $LA5_4$, a pair of diodes $D5_1$ and $D5_2$ and $D5_3$ and $D5_4$ for each two lamps. A pair of capacitors $C5_1$ and $C5_2$ are connected across the voltage source VS. An inductor $L5_1$ is connected to the junction point between capacitors $C5_1$ and $C5_2$ as well as to the junction points of diodes $D5_1$ and $D5_2$ and lamps $LA5_1$ and $LA5_2$. Similarly a second inductor $L5_2$ is connected to the junction point between capacitors $C5_1$ and $C5_2$ and to the junction points between diodes $D5_3$ and $D5_4$ and lamps $LA5_3$ and $LA5_4$. The grids of lamps $LA5_1$ through $LA5_4$ are each connected to the pulse generating circuit $PGC_5$.

In operation a pair of lamps $LA5_1$ and $LA5_4$ are operated together while lamps $LA5_3$ and $LA5_2$ are off and likewise lamps $LA5_3$ and $LA5_2$ operate together while lamps $LA5_1$ and $LA5_4$ are off. As those skilled in the art will understand if lamps $LA5_1$ and $LA5_4$ are operated with a prescribed phase relationship between the currents in each of the lamps as determined by the timing of the turn-on and turn-off pulses of each lamp they will provide a predetermined amount of illumination in accordance with that prescribed phase relationship. By shifting that phase relationship to a different phase relationship by changing the turn-on and turn-off times of the pulses to the grids of lamps $LA5_1$ and $LA5_4$ one in effect rotates the vectors representing the currents through the lamps with respect to one another and consequently changes the effective current through the lamps. If this phase shift is done to reduce the effective current through the lamps a dimming effect is achieved which operates the lamps at an illumination below the predetermined illumination provided when there is the prescribed phase relationship. It is to be understood that lamps $LA5_3$ and $LA5_2$ can be operated in the same manner. As a consequence a dimmable lamp system is obtainable by providing pulse generating circuitry which is capable of changing the timing of its pulses. As those skilled in the art will understand, dimming is also possible by changing frequency and phase.

It is to be understood that the arrangement shown in FIG. 5 does not only provide a dimmable arrangement but also one in which the aging of lamps and the consequent deterioration of efficiency can be offset if the prescribed phase relationship between the turn-on pulses for each pair of lamps is not designed to produce the maximum effective current for normal operation but is designed to produce less than that maximum effective current. As a result as lamps age the effective current can be increased by phase shifting to offset the deterioration in efficiency. The arrangement of FIG. 2 can provide this advantage also by changing the frequency of operation.

It should be apparent that modifications of the above will be evident to those skilled in the art and that the arrangement described herein is for illustrative purposes and is not to be considered restrictive.

What is claimed is:

1. In combination, a source of voltage, a fluorescent lamp connected to said source of voltage for operation in response thereto from a non-conductive state to a conductive state, said fluorescent lamp having a control grid which operates to control said fluorescent lamp in both it conductive and non-conductive states in response to control signals received by said control grid and control means generating said control signals.

2. The combination according to claim 1 wherein said source of voltage is a DC voltage.

3. The combination in accordance with claim 1 wherein said fluorescent lamp is connected in series with an inductor.

4. A combination in accordance with claim 3 wherein said inductor is part of an inductive capacitive circuit.

5. A combination in accordance with claim 1 wherein said control means includes pulse generating circuits for applying pulses to said control grid.

6. A combination in accordance with claim 5 including two fluorescent lamps each having a control grid and said control means includes pulse generating circuits for applying pulses to each said control grid.

7. A combination in accordance with claim 5 including a switch in series with said lamp said switch being operated to its non-conducting state by a pulse from said pulse generating circuits when said lamp is to be turned off.

8. A combination in accordance with claim 5 including a plurality of lamps in parallel, said lamps being operated in sequence by the application of pulses to their respective grids.

9. A combination according to claim 5, including four fluorescent lamps each having a control grid and said control means includes pulse generating circuits for applying pulses to each said control grid, said lamps being connected to operate two at a time in pairs, said pulse generating circuits being capable of shifting the phase of operation of at least one lamp of each pair with respect to the operation of the other lamp of said pair, each pair operating in a prescribed phase relationship to each other to provide a predetermined amount of illumination, said shifting of said prescribed phase relationship causing illumination at an amount below said predetermined illumination.

10. A combination according to claim 9 wherein said source of voltage is a DC voltage.

11. The combination in accordance with claim 9 wherein said fluorescent lamps are connected in series with an inductor and said source of voltage is a DC voltage.

12. The combination according to claim 2 wherein said fluorescent lamp is connected in series with an inductor.

13. The combination in accordance with claim 2 wherein said control means includes pulse generating circuits for applying pulses to said control grid.

14. A combination in accordance with claim 3 wherein said control means includes pulse generating circuits for applying pulses to said control grid.

15. A combination in accordance with claim 12 wherein said control means includes pulse generating circuits for applying pulses to said control grid.

16. A combination in accordance with claim 13 including four fluorescent lamps each having a control grid and said control means includes pulse generating circuits for applying pulses to each said control grid, said lamps being connected to operate two at a time in pairs, said pulse generating circuits being capable of shifting the phase of operation of at least one lamp of each pair with respect to the operation of the other lamp of said pair, each pair operating in a prescribed phase relationship to each other to provide a predetermined amount of illumination, said shifting of said prescribed phase relationship causing illumination at an amount below said predetermined illumination.

17. A combination according to claim 12 including four fluorescent lamps each having a control grid and said control means includes pulse generating circuits for applying pulses to each said control grid, said lamps being connected to operate two at a time in pairs, said pulse generating circuit being capable of shifting the phase of operation of at least one lamp of each pair with respect to the operation of the other lamp of said pair, each pair operating in a prescribed phase relationship to each other to provide a predetermined amount of illumination, said shifting of said prescribed phase relationship causing illumination at an amount below said predetermined illumination.

18. A combination according to claim 5, including four fluorescent lamps each having a control grid and said control means includes pulse generating circuits for applying pulses to each said control grid, said lamps being connected to operate two at a time in pairs, said pulse generating circuits being capable of shifting the phase of operation of at least one lamp of each pair with respect to the operation of the other lamp of said pair, each pair operating in a prescribed phase relationship to each other to provide a predetermined amount of illumination, said shifting of said prescribed phase relationship causing illumination at an amount above said predetermined illumination.

19. A combination according to claim 18 wherein said source of voltage is a DC voltage.

20. The combination in accordance with claim 18 wherein said fluorescent lamp is connected in series with an inductor and said source of voltage is a DC voltage.

21. A combination in accordance with claim 5, including a plurality of lamps in parallel, said lamps being operated concurrently, each operating at a different duty cycle.

* * * * *